United States Patent [19]

Ogata

[11] Patent Number: 4,585,357

[45] Date of Patent: Apr. 29, 1986

[54] HOMOGENIZER

[76] Inventor: Kazuo Ogata, 536-3 Ooaza Shirasago, Yuki-cho, Saiki-gun, Hiroshima, Japan

[21] Appl. No.: 662,234

[22] Filed: Oct. 18, 1984

[51] Int. Cl.[4] ..... B01F 5/00; B01F 5/06

[52] U.S. Cl. ..... 366/176; 99/452; 251/121; 366/337; 366/340

[58] Field of Search ..... 366/138, 176, 336–340; 99/452, 453, 460; 137/1, 15, 625.3, 625.33; 251/121; 138/46

[56] References Cited

U.S. PATENT DOCUMENTS 4,352,573 10/1982 Pandolfe ..... 366/176

*Primary Examiner*—Timothy F. Simone

*Attorney, Agent, or Firm*—Koda and Androlia

[57] ABSTRACT

A homogenizer with the system designed to jet out emulsions and dispersed solutions from inter-valve microgaps, under high pressure. The microgaps for jetting out the homogenizing liquid are disposed in series at a plural number of locations. Also, it is designed such that the homogenizing liquid passes through two types of gaps, that is, narrow and wide microgaps in consecutive order. Furthermore, discharge ports are constructed with a design such that the homogenized liquid is discharged smoothly without interrupting the homogenization process. In this manner, a large quantity of the liquid can be treated with low homogenization pressure.

13 Claims, 12 Drawing Figures

HOMOGENIZER

BACKGROUND OF THE INVENTION

1. Field of the Invention

The present invention relates to a homogenizer, and particularly to a homogenizer for homogenizing an emulsion by jetting out the emulsion from spaced apart microgaps in order to break up the liquid components into minute particles for effecting the homogenization.

2. Prior Art

The process of homogenization of emulsion or dispersed solution is mainly applied to separating fat globules of milk into fine particles so that the formation of cream is prevented or delayed, or for treating dispersed solutions containing pigments, chemicals, etc.

The generally used process for homogenization has been to eject a liquid, that is under a high pressure as high as 100–210 kg/cm$^2$ applied by a high pressure pump, from a micro-slit formed between valves, then to let the sprayed out liquid smash against a wall surface.

The working mechanism in homogenization is not fully clarified theoretically, but the following is assumed. That there is a very strong shearing force acting upon the liquid components during the passage of the liquid through the microgap, a sudden change the liquid undergoes when it is rapidly pushed out from the high pressure area to the low pressure area, i.e. the cavitation, and the impact destruction cause when the liquid, ejected from the microgap, smashes against the wall surface and all contribute to the subdivision of the liquid components into minute pieces, thereby effecting homogenization.

Accordingly, the degree of homogenization is dependent on the factors, such as the difference in pressure of the liquid before and after passage through the microgap, the impact force upon colliding against the collision wall, and the presence or absence of something blocking the flow of the liquid.

Conventional homogenizers using the abovementioned homogenization process have been constructed as a single valve system homogenizer including ring-form spaced apart microgaps formed by a couple of valve seats and a valve, collision walls formed of circumferential surfaces provided at certain intervals by locating them outside of the spaced apart microgaps, one-directional outlets for the homogenized liquid, and a plunger pump for feeding the liquid at high pressure.

If the homogenizing capacity is to be doubled by using this conventional single valve system homogenizer, the diameter of the valve must be doubled to double the circumferential length.

When the diameter of the valve is doubled, the valve area becomes four times larger in proportion to the square of the diameter; and if the valve area that is increased to four times is to receive the high liquid pressure, the thrust applied to the valve also must be increased four times. Accordingly, as the diameter of the valve is made larger, the valve becomes subjected to a sharply growing thrust. In parallel with it, the structure of each component part of the system has to be reinforced to withstand such strong thrust. This in return requires tremendously high cost for the equipment. Therefore, in reality, it is dangerous and impractical for the liquid pressure to exceed a certain level.

Consequently, in order to increase the operational capacity by using this type of homogenizer, it is necessary to increase the number of homogenizers. However, to implement such an arrangement requires an increase in cost for the equipment as well as the cost for the power used, and it defeats the purpose which is the improvement in efficiency.

Furthermore, in this type of conventional homogenizer, the outlet for the homogenized liquid after colliding with the collision wall is provided only for one-directional flow. As a result of the liquid scattering in all directions after clashing into the collision wall, the portion that is splashed in directions other than in the direction of the outlet is formed to shift its direction, after colliding with the other wall surface, to that heading to the outlet. This portion of the homogenized liquid that is formed to change its flowing direction interferes with the other liquid portion ejection from the microgaps as well as its scattering from the collision wall, and checks the flow of such other liquid portion, thereby causing lowered homogenizing performance.

In light of such shortcomings of the current homogenization technique, an improvement has been called for to obtain a homogenizer equipped with higher performance and higher operational efficiency.

SUMMARY OF THE INVENTION

The object of the present invention is to provide a homogenizer for homogenizing emulsions or dispersed solutions, that is economically advantageous since it is capable of treating a large amount of liquid with lower pressure than that used in the conventional homogenizer, it shows an excellent homogenizing effect as well as large quantity processing capacity, and also it is capable of saving input energy for its operation.

The homogenizer provided by the present invention includes a bearing valve seat, a presser valve seat, and one or a plural number of cylindrical homogenizing valves. The bearing valve seat is inserted at one end on the inlet side of the homogenization cylinder, and it has a passage for the liquid to be homogenized (homogenizing liquid) that is fed by pressure into the area along the axes (shaft center area) of the valve members. The presser valve seat is installed at the other end of the homogenizing cylinder. The cylindrical homogenizing valves are disposed in series between bearing valve seat and the presser valve seat, and each of those cylindrical homogenizing cylinders has a homogenizing liquid passage at its center along the axis thereof.

In the portions where the valve members are composed of the homogenizing valve, the bearing valve seat and the pressure valve seat come into contact with each other and spaced apart micro-gaps are formed. The high pressure homogenizing liquid supplied by way of the homogenizing liquid passages provided in the center along the axes of the bearing valve seat and the homogenizing valve is jetted out via the spaced apart microgaps provided at a plurality of locations.

Outside of the microgaps, ring-form caves are formed by cutting out the inner wall of the homogenization cylinder or the outer wall of the homogenizing valve. These ring-form caves' sides on the inner wall side of the homogenization cylinder are used as collision walls for the liquid spurted out from the spaced apart microgaps.

On both sides in the width direction of the foregoing collision walls or at positions near the former locations, a plural number of discharge ports are formed along the circumference. These discharge ports are formed by boring through the circumferential wall of the homogenization cylinder, and they are connected to the homogenized liquid passage that is formed between the outer circumferential wall of the homogenization cylinder and the housing such that they surround the homogenization cylinder.

With the discharge ports provided in such a constructional arrangement, the liquid portions dispersed after hitting the collision wall are prevented from causing interference with each other, and they are orderly discharged from both sides through the discharge ports.

Thus, the number of ejection ports of the valves is increased, and the homogenized liquid can be discharged smoothly without interrupting the ejection and collision of the other liquid portion. Through the synergistic effect resulting from the above, outstanding homogenization effect and capability for treating a large amount of liquid with low homogenization pressure can be obtained through the homogenizer provided by the present invention.

Furthermore, the space size of the circular spaced apart microgaps formed by the bordering valve member is divided into two types, that is, wide and narrow space sizes. The wide and narrow microgaps are either separated by a grooved space formed by providing a circular groove along one or both of the bordering surfaces of the valve members, or connected to each other side by side. In either case, the outermost one is formed into a wide microgap. In this way, the homogenizing liquid jetted out from the circular center of the microgap towards the outside is homogenized under high liquid pressure by receiving high resistance as it passes through the narrow microgap located on the inner circumferential side; then, when the same liquid passes through the outermost microgap with a wide space, still higher homogenization effect can be obtained in the homogenizer provided by this invention.

In the manner described above, the objects of the present invention are achieved.

DETAILED DESCRIPTION OF THE INVENTION

The present invention relates to a homogenizer used for treating liquids, and a detailed description of it will be given below with reference to the drawings.

Figure 1:
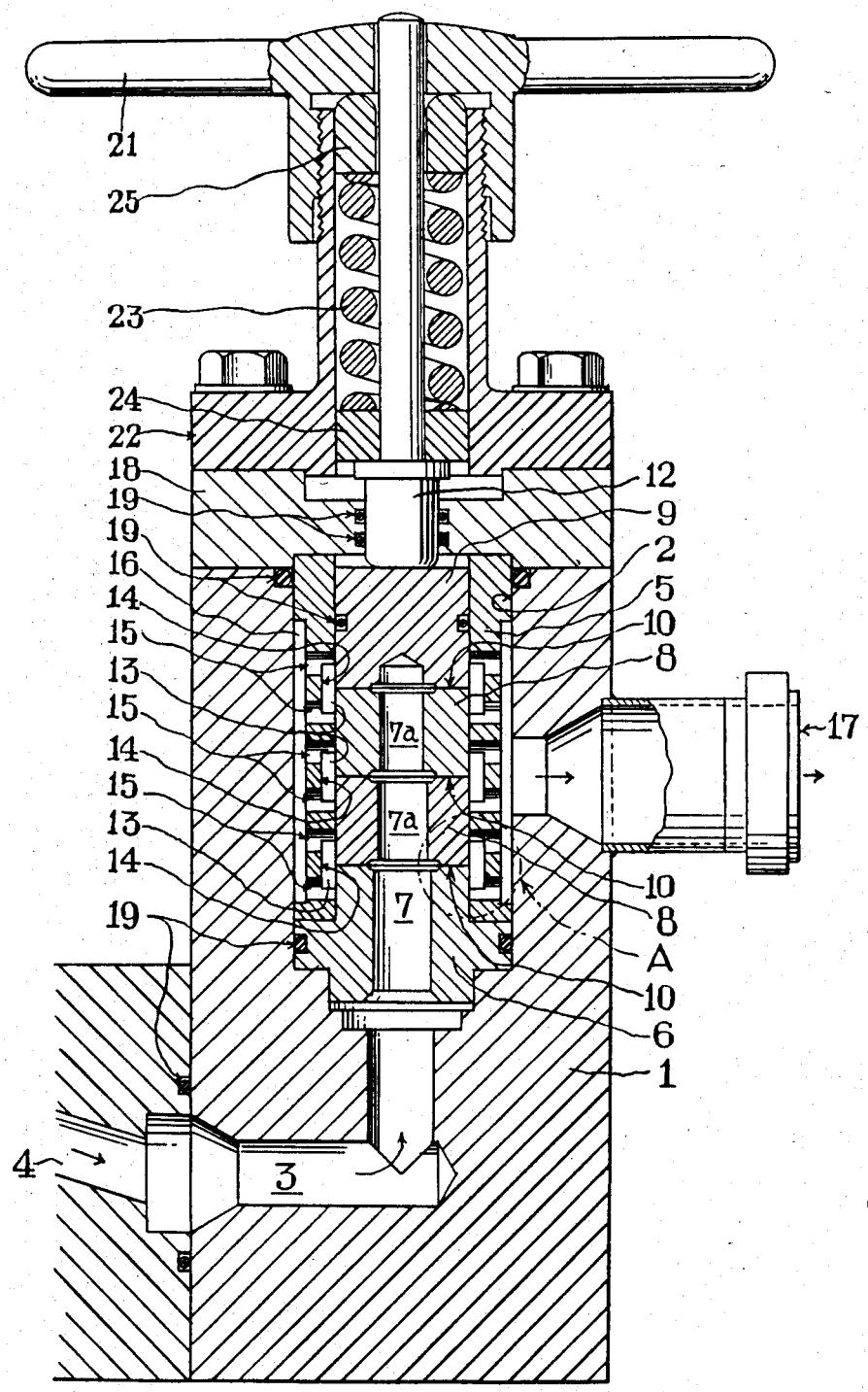
FIG. 1 is a vertical sectional view showing an embodiment of a homogenizer of the present invention.
Figure 2:
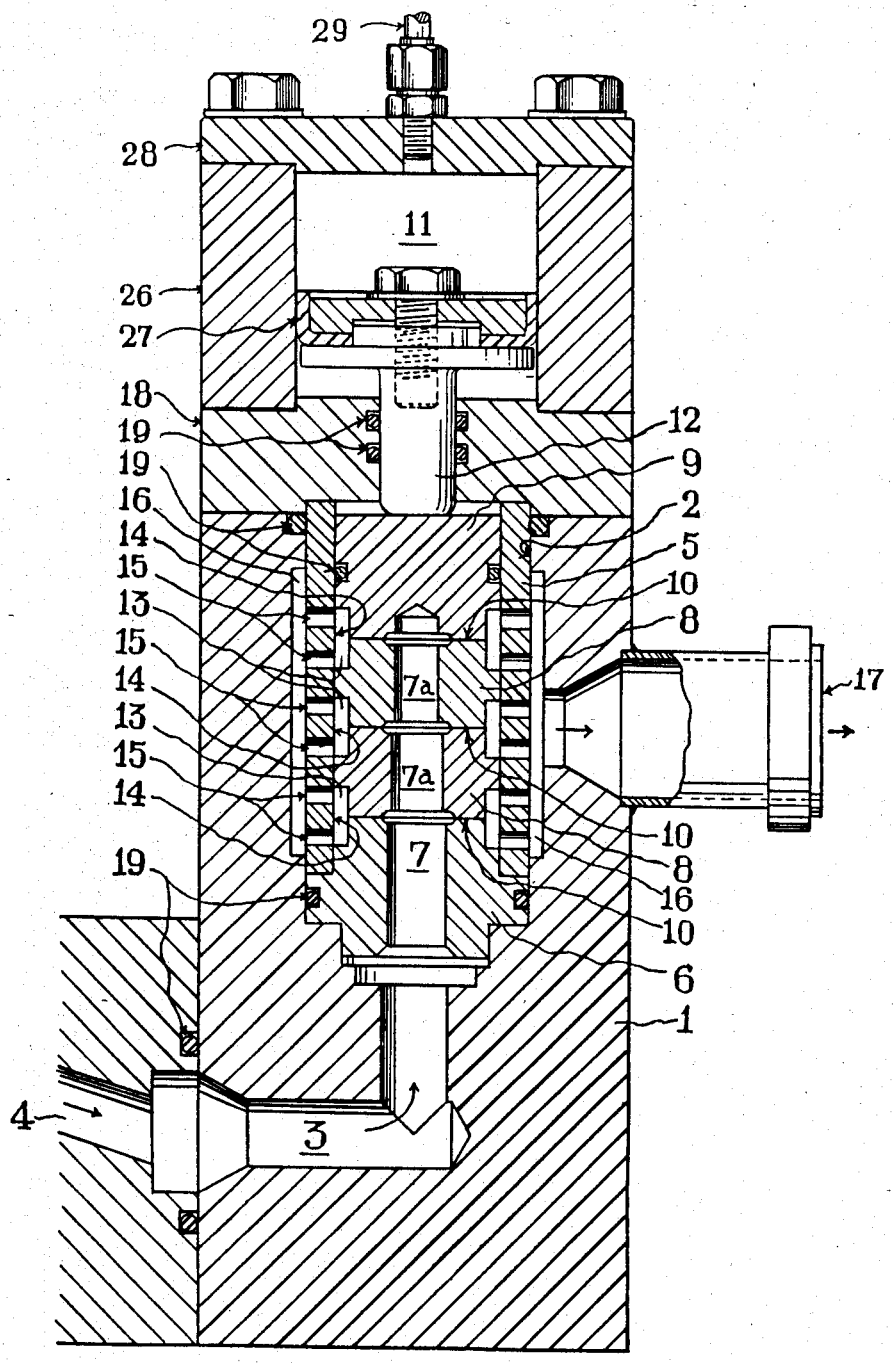
FIG. 2 is a vertical sectional view showing another embodiment of a homogenizer of the present invention.

FIGS. 1 and 2 are vertical sectional views of preferred embodiments of homogenizers constructed according to the present invention. The internal portion of housing 1 is cut out to form a homogenization chamber 2. An inlet 3 for feeding the liquid to be homogenized (homogenizing liquid), that is connected to the foregoing homogenization chamber 2, is provided at the lower portion of the housing 1. To this homogenizing liquid inlet 3, an outlet 4 of a high pressure plunger is connected.

Figure 4:
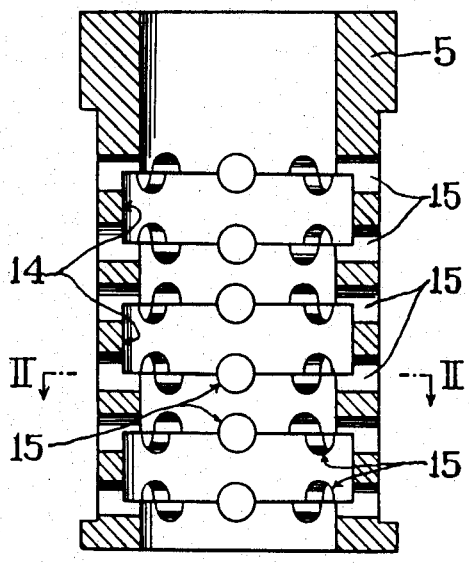
FIG. 4 is a vertical sectional view of a homogenization cylinder for the homogenizer provided by the present invention shown in FIG. 1.
Figure 5:
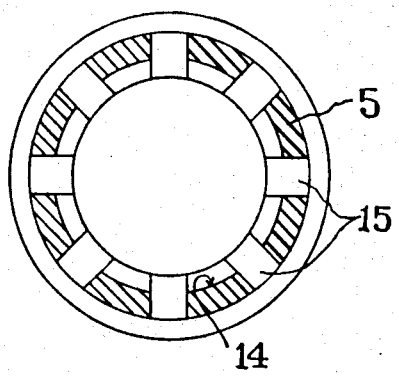
FIG. 5 is a sectional view taken along the line II—II in FIG. 4.

In the homogenization chamber 2, a cylindrical homogenization cylinder 5, illustrated in FIGS. 4 and 5, is installed together with a bearing valve seat 6 inserted in the lower end of the homogenization chamber 2. This bearing valve seat 6 is provided, in its center along an axis, with a homogenizing liquid passage 7 connected to the homogenizing liquid inlet 3, by forming the homogenizing liquid passage 7 through a hole.

In the abovementioned homogenization cylinder 5, one or a plural number of homogenizing valves 8 are inserted in series. In the center along the axis of the homogenizing valve 8, the same homogenizing liquid passage *7a* connected to the homogenizing liquid passage 7 of the bearing valve seat 6 is provided in the form of a through hole.

Furthermore, next the homogenizing valve 8, a cylindrical presser valve seat 9 without a homogenizing liquid passage along its axis is installed at the upper end of the homogenization cylinder 5.

Between the mutually facing surfaces of both ends of the homogenizing valve 8, the end of the bearing valve seat 6, and the end of the presser valve seat 9, ring-form spaced apart microgaps 10 are formed.

The size of the space of these microgaps 10 is controlled by the pressure applied to the presser valve seat 9, from outside of the housing 1, by a push rod 12 of a pressure (pres-surizing) device 11 operated manually or by using a motor, such as a hydraulic motor.

Also, the end surfaces of the bearing valve seat 6, the homogenizing valve 8 and the presser valve seat 9, which form the microgaps, are finished into high hardness and high precision surfaces in order to prevent wear and to maintain accuracy by the use of high-grade non-rusting steel, quench hardening of high quality steel, adhesion of hard material, or the use of other measures.

Along the outer circumference of the foregoing spaced apart microgaps 10, ring-form spaces (clearances) 13 are formed by cutting out either the inner circumferential wall of the homogenization cylinder 5 or the outer circumferential wall of the homogenizing valve 8. The surface of this ring-form space 13, that is located on the inner wall side of the homogenization cylinder 5, is used as a collision wall 14 for the liquid jetted out from the microgaps 10. Located on both sides of the collision walls 14, along the direction of the width of the collision walls 14, or at locations near the abovedescribed both sides of the collision walls 14, a plural number of discharge ports 15 are formed in the circumferences by boring holes through the circumferential wall of the homogenization cylinder 5. By way of these discharge ports 15, the ring-form space 13 is connected to a homogenized liquid passage 16 formed outside of the homogenization cylinder 5 by cutting out either the outer circumferential wall of the homogenization cylinder 5 or the outer circumferential wall of the housing 1.

A homogenized liquid outlet 17 is connected to the homogenized liquid passage 16. A housing seal cover 18 is interposed between the housing 1 and the pressure device 11, and it also serves to confine and fix the homogenization cylinder 5 and the bearing valve seat 6 in the housing 1 holding within the housing 1.

In addition, because the high pressure liquid flows in this homogenizer in portions in which possible liquid leakage may occur, O-ring packings 19 are inserted in them.

As to the width w of the ring-form space 13, as a result of tests conducted by using milk under the conditions of homo-genizing valve 8 of 34 mm in diameter, 70–140 kg/cm$^2$ in homogenizing pressure, and 25 kg/cm$^2$–40 kg/cm$^2$ (507 kg/–811 kg when converted to the pressing force of the bearing valve seat 9) in hydraulic pressure applied to a hydraulic piston 27 (2 inches, i.e. 50.8 mm in diameter) of the pressure device 11, it was found that the best homogenization effect is shown when the width of the ring-form space 13 is set to be 5–6 mm.

The homogenizing liquid passage 7 of the bearing valve seat 6 and the homogenizing liquid passage 7*a* of the homogenizing valve 8 are formed as through holes provided in the center along the axes of those valve members. These homogenizing liquid passages 7 and 7*a* shown in the Figures are reduced in their diameters one after another along the flow direction of the homogenizing liquid. Although no specific drawback is caused when these passages are formed with the same diameters without reducing their diameters in consecutive order, better test results were obtained when the passages are reduced in diameter in serial order as shown in the Figures.

Figure 3:
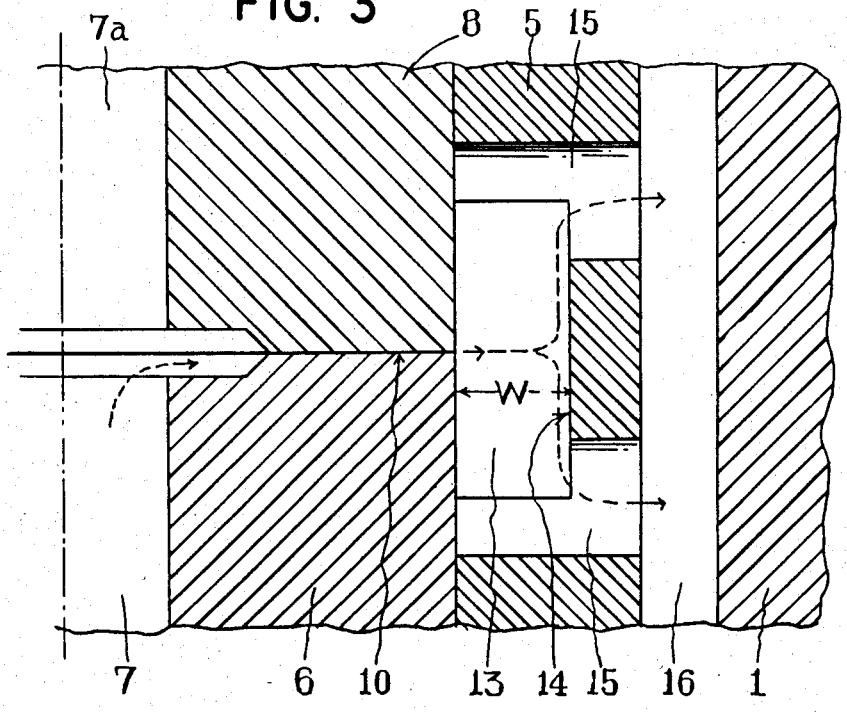
FIG. 3 is an enlarged detailed view showing a portion A of FIG. 1.

With respect to the end surfaces of the valve members composed of the bearing valve seat 6, the homogenizing valve 8 and the presser valve seat 9, which form the ring-form microgaps by mutually facing each other may, these end surfaces may be formed into flat bordering surfaces as shown in FIGS. 1 through 3. However, as shown in FIGS. 6 through 9, the microgaps 10 may be divided into two types, that is, narrow and wide gaps, and by forming the ones located on the inner side into the narrow gap 10*a*, while forming the ones located on the outer side into the wide microgap 10*b*, the homogenizing liquid is maintained at high pressure due to the high resistance of the narrow microgap 10*a* against the passage of the homogenizing liquid. Thus, the homogenizing liquid is jetted out at high speed and homogenized. Then, when this liquid passes through the wide microgap 10*b* following the narrow microgap 10*a*, a still higher homogenization effect is obtained for the same homogenizing liquid.

The size of the space of the narrow microgap 10*a* is determined depending on the amount of the pressure applied by the pressure device 11 to the bearing valve seat 9 disposed on top of the stacked up valve members, and it is set to be 0.0004 in. (0.01 mm) or less for the extremely narrow microgaps 10*a*. The range of the size of the wide microgaps 10*b* is set to be 0.0004 in. (0.01 mm) to 0.004 in. (0.1 mm), and the preferable range is 0.0008 in. (0.02 mm) to 0.002 in. (0.05 mm).

The width (the length for the passage of the liquid) of the narrow microgap 10*a* is set to be 0.02 in. (0.5 mm) or more, and the width (the length for the passage of the liquid) of the wide microgap 10*b* is set to be in the range of 0.01 in. (0.25 mm) to 0.06 in. (1.5 mm), with the preferable range set at 0.015 in. (0.38 mm) to 0.04 in. (1.0 mm).

It was further found out by experiment that when, next to the wide microgap 10*b*, a circular dispersion groove 30 which is expanded toward the outer circumference of the valve member is provided, the homogenization effect is further improved.

The embodiments showing the configuration around the microgaps are shown in FIGS. 6 through 9.

Figure 6:
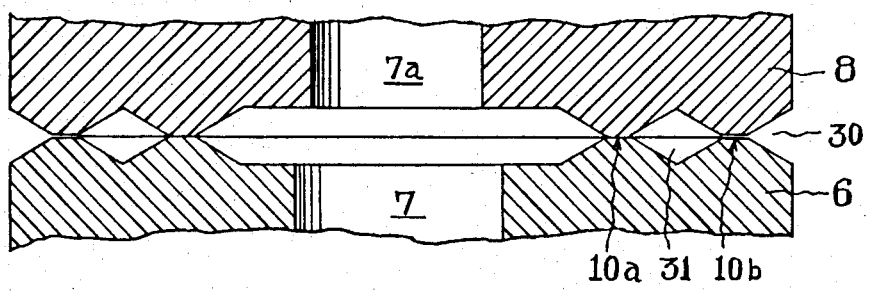
FIG. 6, FIG. 7, FIG. 8 and FIG. 9 are enlarged detailed sectional views showing respectively different shapes of spaced apart microgaps formed by joining the valve members.

In FIG. 6, between both surfaces of the valve members which are bordering on each other, a grooved space 31 is formed by providing a circular groove along each of the foregoing surfaces in a mutually facing manner. On the inner circumferential side of this grooved space 31, the narrow microgap 10*a* is formed, while the wide microgap 10*b* is formed on the outer circumferential side of the grooved space 31. Then, on the outer side of the wide microgap 10*b*, the circular dispersion groove 30 is formed.

Figure 7:
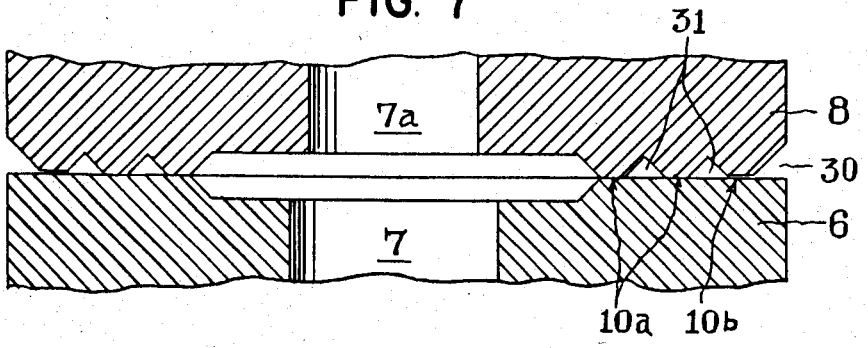

In FIG. 7, one of the mutually facing bordering surfaces of the valve members is formed into a flat surface. Along another of the foregoing surfaces, two concentric circular grooves are formed thereby providing the grooved space 31 at two locations. As a result, three microgaps 10 are formed. Of these three microgaps, the outermost one is formed into a wide microgap 10*b*, and outside of this wide microgap 10*b*, the circular dispersion groove 30 is provided.

Figure 9:
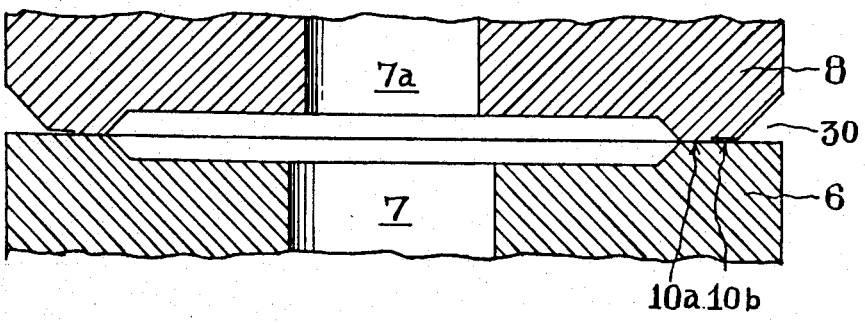

In FIG. 9, the narrow microgap 10*a* on the inner side and the wide microgap 10*b* on the outer side are formed contiguously by forming a two-step structure. Next to the wide microgap 10*b*, the circular dispersion groove 30 is provided.

Figure 8:
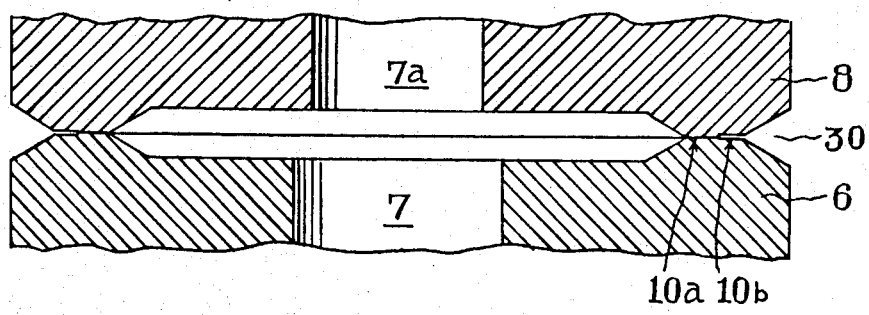

In FIG. 9, an embodiment having the same structure as that shown in FIG. 8 but with one of the mutually facing contact surfaces of the valve members formed into the flat surface is shown.

In the above four embodiments are presented for the structure of the microgaps. However, the structure of the microgaps is not limited to these embodiments, and other modifications may be made. For example, the grooved space 31 shown in FIG. 7 may be further increased in number, and more than three microgaps may be provided. The structure of the microgaps is to be selected from various types of structures described above, depending on the type of the liquid subjected to homogenization as well as the required degree of the homogenization.

The essential point in the above is that the microgaps are formed into two types, that is, narrow and wide microgaps.

The reason for forming one of the mutually facing surfaces of the valve members into a flat surface as shown in FIGS. 7 and 9 is related mainly to the circumstances of the work to construct the valve members. Forming one of the surfaces into a flat surface instead of forming both of the mutually facing surfaces with complicated processing work is advantageous since the work for construction is made easier. Besides, almost no adverse effect on the homogenization due the above described simplification of the structure was shown in the test results.

In the embodiment shown in FIG. 1, the ring-form space 13 and the homogenized liquid (the liquid as the product of homogenization) passage 16 are formed by cutting out the inner circumferential wall and the outer circumferential wall of the homogenization cylinder 5. As the pressure device 11, a manual type system is used. In this pressure device 11, 21 is a pressure handle, 22 is a pressure device body, 23 is a pressure spring, 24 is a pressure spring support, and 25 is a pressure spring holder.

In the embodiment shown in FIG. 2, the ring-form space 13 is formed by cutting out the outer circumferential wall of the homogenization member, while the homogenized liquid passage 16 is formed by cutting out the inner circumferential wall of the housing 1. As the pressure device 11, a hydraulic type system is used. In the pressure device 11, 26 is a hydraulic cylinder, 27 is the hydraulic piston, 28 is a hydraulic cylinder cover, and 29 is a hydraulic pipe.

The homogenizers shown in these Figures are constructed vertically. However, even if they are turned into a horizontal type, the structure and the operational effect remains the same.

Hereunder, a description will be given on the homogenization carried out by using the homogenizers having the structures as described above.

Homogenization of milk means to break up the fat globules contained in the milk into fine particles. Most of the fat globules in milk are in the range of 1–16$\mu$ in diameter, and as these fat globules are low in specific gravity, in accordance with the Stokes law, they rise to the surface of the milk with a speed proportional to their size. The surfaced fat globules form a cream layer on the surface of the milk. However, when the fat globules are less than 2$\mu$ in size, it becomes difficult for them to come up to the surface because the viscous friction becomes stronger than the buoyant force.

Therefore, the purpose of the homogenization of milk is to break down the fat globules into the smallest size possible, i.e., smaller than 2$\mu$ (in diameter).

In FIGS. 1 and 2, the homogenizing milk (the milk to be homogenized) sent by the plunger pump is supplied via a plunger pump outlet 4 to the homogenizing liquid inlet 3, then it is led to the homogenizing liquid passage 7 and 7*a*. Here, the flow direction of the homogenizing milk is turned 90 degrees, and it is spouted out into the ring-form spaces 13 through the microgaps provided at three locations, the clashes violently into the collision walls 14. During this process, a large shearing force is applied to the fat globules contained in the milk when it passes through the microgaps 10; also, when the milk is ejected into the ring-form spaces 13, due to the sudden change from high pressure to low pressure, an abrupt change, that is, cavitation is caused. As a result, the fat globules are separated into minute particles. Right after this, the milk smashed violently against the collision walls 14, thus causing the breakage of the fat globules into further minutes pieces due to the impact. In this way, the homogenization is performed.

As for the microgap 10, when it is divided into two types, i.e., narrow microgaps 10*a* and wide microgaps 10*b* disposed on the outer side as shown in FIGS. 6 through 9, better homogenization is obtained in comparison with cases wherein the microgap 10 is formed simply into flat surfaces.

In other words, first, the homogenizing milk passes through the narrow microgaps 10*a* from the homogenizing liquid passages 7 and 7*a* provided in the center along the axes of the valve members. As this time, the milk receives a high degree of resistance by the extremely narrow space. Consequently, the liquid pressure in the homogenizing liquid passages 7 and 7*a* becomes high, and the milk passes through the narrow microgaps 10*a* with high speed. In the cases shown in FIGS. 6 and 7, when the milk is jetted out to the grooved space 31, cavitation is caused and the fat globules are separated into microparticles. Following this, when the milk passes through the wide microgaps 10*a* and is ejected into the circular dispersion grooves 30, and again the cavitation is caused. Due to this cavitation, once more, the remaining fat globules are broken into minute particles. Then, the milk is dispersed by the circular dispersion grooves 30, and spurted out to the ring-form spaces 13. There, the same as in the previously mentioned case, the milk crashes against the collision walls 14 and further crushes the fat globules into microparticles.

The major difference between the embodiments shown in FIGS. 6 and 7 is the number of narrow microgaps 10*a*, that is, one in FIG. 6 and two in FIG. 7. The passage resistance caused against the homogenizing milk is higher with two of the narrow microgaps 10*a* than with a single narrow microgap 10*a*. Also, since the grooved space 31 is provided at two locations in the former case, the cavitation effect occurs twice.

In the embodiments shown in FIGS. 8 and 9, the grooved space 30 is eliminated by connecting the narrow microgap 10*a* and the wide microgap 10*b* directly. However, since some cavitation effect is shown when the homogenizing milk is ejected from the narrow microgap 10*a* to the wide microgap 10*b*, no significant difference was found in the results of experiments when compared with the case having the grooved space 30 shown in FIG. 6.

The milk thus homogenized is scattered after colliding against the collision walls 14, and discharged to the homogenized liquid passage 16 through the discharge ports 15 and then taken out from the homogenized liquid outlet 17.

One of the major features of this invention is that the liquid flows smoothly after being homogenized. In the conventional homogenizer, in the portion shown in FIG. 3, the discharge port 15 is provided only on one side instead of at both sides. Due to the above, the liquid portion that is splashed to the side without having the discharge port 15 has to flow back and gets out from the discharge port provided on the other side while running against and passing through the other portion of the liquid that is jetted out from the microgap 10. As a result, interfe-rence with the jetting out liquid as well as with the liquid that is splashing by the impact is caused by the liquid portion scattered to the side without the discharge port 15 provided, thus leading to an interruption of the homogenization process. Such defective points have been left unnoticed and overlooked.

In the present invention, by noting that the above described obstruction against the ejection and the collision due to the interference caused in the conventional homogenizer seriously affects the homogenization effect, the improvements were achieved to solve the foregoing problems. As shown by the arrows in FIG. 3, the milk hitting against the collision wall 14 is separated from both sides and orderly discharged to the discharge ports 15. Therefore, it does not happen that the flow of the milk is disturbed in the ring-form space 15 thus causing an interruption to the ejection from the microgap 10 and to the impact at the collision wall 14. Consequently, the homogenization can be carried out with excellent efficiency.

Figure 10:
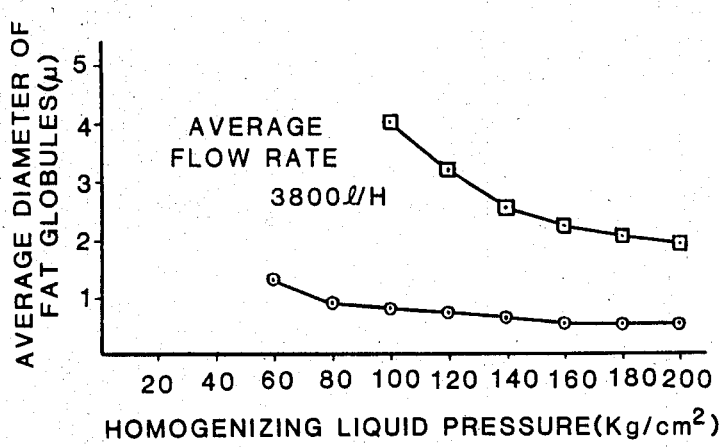
FIG. 10 is a graph comparing the homogenizing effect between the conventional homogenizer and the homogenizer provided by the present invention, based on the pressure of the liquid to be homogenized.
Figure 11:
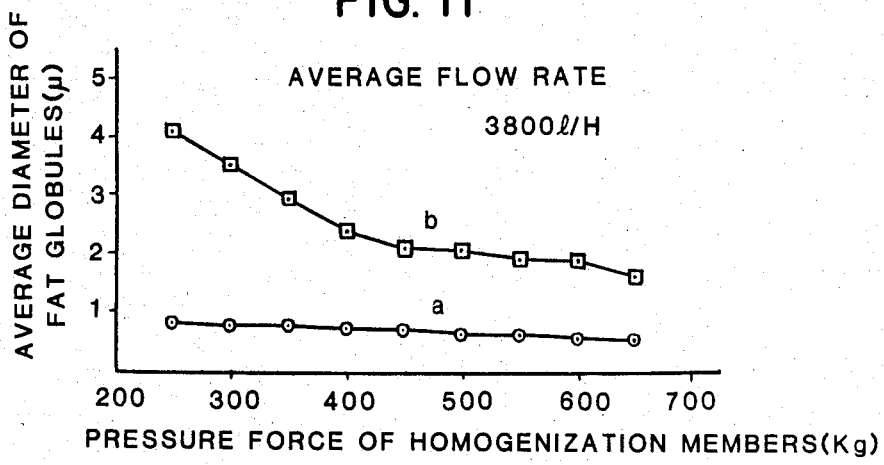
FIG. 11 is a graph of a comparison of the homogenizing effect between the conventional homogenizer and the homogenizer according to the present invention, with respect to the pressing force of the valve members.
Figure 12:
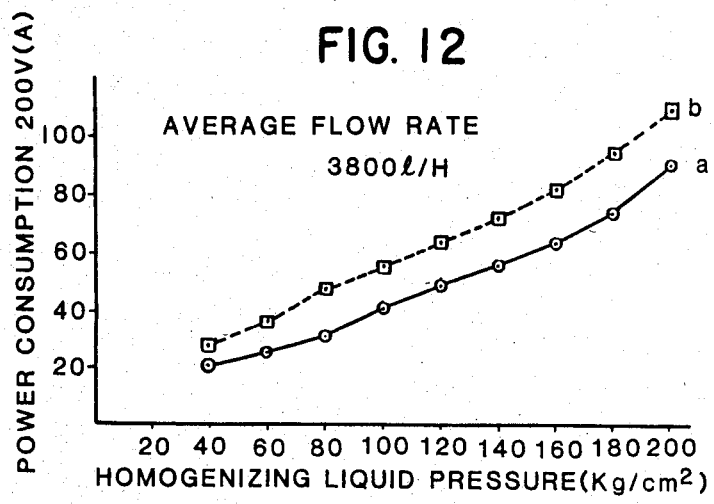
FIG. 12 is a graph showing a comparison between the conventional homogenizer and the homogenizer in accordance with the present invention, with regard to the consumption of power during operation.

The effects brought about by the present invention are the homogenization effect shown in FIGS. 10 and 11, and the homogenization efficiency shown in FIG. 12, which are remarkably superior to those obtained by conventional homogenizers.

That is, FIGS. 10 through 12 are the graphs showing the results of experimental comparison between the conventional homogenizer having a flat form interhomogenization ejection slit at one location and the homogenizers according to the present invention shown in FIGS. 1 and 2 wherein, the interhomogenization ejection opening is provided at three locations with a narrow microgap 10*a* and a wide microgap 10*b* provided at each location, and the difference between the narrow microgap 10*a* and the wide microgap 10*b* is set to be 0.0015 in. (0.038 mm). A comparison was conducted by using the same amount of liquid flow (flow rate). In the graphs, a letter "a" denotes the results obtained for a homogenizer provided by the present invention, and "b" represents the results shown by a conventional homogenizer.

In FIG. 10, the average diameter of the fat globules mixed in the homogenized liquid is shown based on the homogenizing liquid pressure. In the results represented by "a" for the present invention, the average diameter of the fat globules is 0.8$\mu$ at 80 kg/cm$^2$ in homogenizing liquid pressure, and with increase in homogenizing liquid pressure, the fat globules are further sub-divided. When the homogenizing liquid pressure becomes above 160 kg/cm$^2$, the average size of the fat globules becomes 0.5–0.6$\mu$. Thereafter, even if the homogenizing liquid pressure is increased, no substantial change occurs.

On the other hand, in the results represented by "b" for the conventional homogenizer, although the maximum fat globule diameter is decreased with increase in the homogenizing liquid pressure, an average fat globule diameter less than 2$\mu$ is not obtained unless the homogenizing liquid pressure is increased to above 180 kg/cm$^2$. Thus, it was shown that the homogenizer according to the present invention is by far superior to the conventional homogenizer.

Likewise, FIG. 11 shows the comparison of the average diameter of the fat globules mixed in the homogenized liquid conducted in relation to the pressing force of the valve members. The results indicate that the fat globule becomes smaller with increase in pressing force, that is, with decrease in the space size of the microgap. The same as in FIG. 10, it is apparent that the result "a" for the present invention shows by far excellent homogenization effect with the same pressing force applied, in comparison with the result "b" for the conventional homogenizer.

FIG. 12 shows a comparison of the power consumption based on the homogenizing liquid pressure for the same flow rate. The power source used is 200 V. In this case, as the electric motor, that with 22.5 KW in output is used.

According to the results shown in FIG. 12, when "a" for the present invention is compared with "b" for the conventional homogenizer, the power consumption is lower by 15–30% in the homogenizer provided by the present invention than the power consumed by the conventional homogenizer under the same homogenizing liquid pressure. Accordingly, it is confirmed that the homogenization efficiency is higher in the homogenizer provided by the present invention than in the conventional homogenizer.

The actual homogenization efficiency cannot exactly be rated merely by the comparison in light of the same homogenizing pressure. As shown in FIGS. 10 and 11, as the homogenizer according to the present invention is markedly superior to the conventional homogenizer in terms of the homogenization effect, it can be used with a homogenization pressure lower than that for the conventional one. That is, compared with 150 kg/cm$^2$ of homogenizing liquid pressure used in the conventional homogenizer, in the homogenizer provided by the present invention, a higher homogenization effect can be obtained with 80 kg/cm$^2$. Consequently, the power consumption is reduced substantially. Therefore, in overall evaluation, the homogenizer in accordance with this invention can be operated with about 45% of the power consumed by the conventional homogenizer compared here.

This means that, with the same power cost, the homogenizer provided by the present invention achieves the homogenization of the liquid in amount more than 200% in comparison with that homogenized by the conventional homogenizer, thereby demonstrating a high operational efficiency.

Such remarkable homogenization effect as well as homogenization efficiency are brought about the synergism contributed by the following factors. That is, the microgap 10 functioning as the ejection port is provided at two or more locations; this microgap 10 is constructed into a plural number of concentric circles having two types (narrow and wide) of microgaps, so that after the homogenization is performed at the narrow microgap with the liquid pressure maintained high, the homogenization is again performed at the wide microgap; and the structure is designed to make the flow of the homogenized liquid smooth, in order to eliminate any interruption to the homogenization due to a disturbance of the flow.

As should be apparent from the foregoing description, the homogenizer provided by the present invention is relatively simple in structure, and it is capable of performing fully satisfactory homogenization with extremely high efficiency while requiring low homogenization pressure, thereby making it feasible to produce a sizable economical gain.

Although the invention has been described in its preferred embodiments with reference to the accompanying drawings, it will be obvious to those skilled in the art in this field that various changes and modifications in the form and details may be made without departing from the spirit and scope of the invention as set out in the accompanying claims.

I claim:

1. A homogenizer comprising:

a bearing valve seat that is inserted at an end of a homogenization cylinder, and that has a passage for homogenizing liquid fed by pressure to a center along an axis of the bearing valve seat;

a presser valve seat installed at an other end of the homogenization cylinder;

at least one cylindrical homogenizing valve which are disposed in series, and each of which has a homogenizing liquid passage in a center area along an axis of the homogenizing valve;

inter-valve microgaps formed along bordering portions between valve members consisting of the homogenizing valve(s), the bearing valve seat and the presser valve seat;

ring-formed spaces formed outside of the microgaps by cutting out either an inner wall of the homogenization cylinder or an outer wall of the homogenizing valve, whose walls located on the inner wall side of the homogenization cylinder are used as collision walls for the liquid jetted out from the microgaps; and discharge ports which are formed on both sides of the collision walls along a width direction of the collision wall or at locations near the foregoing locations, and which are connected to a homogenized liquid passage formed along an outer circumferential surface of the homogenization cylinder.

2. A homogenizer as set forth in claim 1, wherein the homogenizing liquid passages provided at the center along the axes of the homogenizing valves which are disposed in plural number are reduced in diameter for each of the valve members in consecutive order along the flow of the liquid.

3. A homogenizer as set forth in claim 1, wherein the discharge port is formed in plural number on each of circumferential positioned at two locations respectively with equal distance given to them from the microgap.

4. A homogenizer as set forth in claim 1, wherein the homogenization cylinder is inserted in a housing, and either the inner wall of the housing or the outer wall of the homgenization cylinder is cut out in order to form a homogenized liquid passage having an outlet for leading the homogenized liquid outside of the housing.

5. A homogenizer as set forth in claim 1, wherein a pressure device for controlling the space size of the interval microgaps through pressing the valve members is provided outside of the housing.

6. A homogenizer according to claim 1, wherein the inter-valve microgaps comprise at least two gaps formed along the bordering ends of the valve members and said microgaps are narrow and wide and the outermost microgaps are wider than the other microgaps.

7. A homogenizer as set forth in claim 1, wherein at least one circular groove is formed along either one or both of the surfaces of the ends of the mutually bordering valve members, thereby forming at least two concentric microgaps with said grooved spaces interposed inbetween.

8. A homogenizer as set forth in claim 1, wherein the microgaps are provided with two-step-form gaps with narrow microgaps formed on the inner circumferential side and the wide microgaps formed on the outer circumferential side next to each other along the mutually bordering contact surfaces of the valve members.

9. A homogenizer as set forth in claim 6, wherein circular dispersion grooves expanding toward an outer circumference of the valve members are formed next to the outermost microgaps.

10. A homogenizer as set forth in claim 6, wherein the size of the space of the wide microgap is in the range of 0.0004 in. to 0.004 in., while the space size of the other narrow microgap is less than 0.0004 in.

11. A homogenizer as set forth in claim 6, wherein the width of the wide microgap is in the range of 0.01 in. to 0.06 in., while the width of the narrow microgap is more than 0.02 in.

12. A homogenizer as set forth in claim 10, wherein the size of the space of the wide microgap is in the range of 0.0008 in. to 0.002 in., while the space size of the other narrow microgap is less than 0.0004 in.

13. A homogenizer as set forth in claim 11, wherein the width of the wide microgap is in the range of 0.015 in. to 0.04 in., while the width of the narrow microgap is more than 0.02 in.

* * * * *